United States Patent [19]

Sweeney

[11] Patent Number: 4,545,855

[45] Date of Patent: Oct. 8, 1985

[54] SUBSTITUTED SUCCINIC ANHYDRIDE/EMULSIFIER COMPOSITION

[75] Inventor: William A. Sweeney, Larkspur, Calif.

[73] Assignee: Chevron Research Company, San Francisco, Calif.

[21] Appl. No.: 480,633

[22] Filed: Mar. 31, 1983

[51] Int. Cl.[4] ..... D21H 3/08

[52] U.S. Cl. ..... 162/158; 8/116.1; 106/243; 162/179; 252/310; 252/311; 252/312; 427/384; 427/394; 427/395

[58] Field of Search ..... 162/158, 179, 135; 8/116 R; 252/310, 311, 312, 356; 106/243; 562/595; 549/255; 427/394, 395, 384

[56] References Cited

U.S. PATENT DOCUMENTS

Re. 29,960 4/1979 Mazzarella et al. ..... 162/158

*Primary Examiner*—Peter Chin

*Attorney, Agent, or Firm*—D. A. Newell; C. J. Caroli

[57] ABSTRACT

A stable composition comprising a hydrocarbyl-substituted succinic anhydride and a polyethylene glycol diester emulsifier. There is also disclosed a method for imparting water repellency to surfaces containing groups reactive to anhydrides and a method for the sizing of paper using said composition.

14 Claims, No Drawings

SUBSTITUTED SUCCINIC ANHYDRIDE/EMULSIFIER COMPOSITION

BACKGROUND OF THE INVENTION

This invention relates to an improved hydrocarbyl-substituted succininc anhydride/nonionic emulsifier composition. This invention also relates to an improved method for imparting water repellency to surfaces containing groups reactive to anhydrides. A further aspect of this invention relates to an improved method for the sizing of paper and paperboard products.

It is well known in the art that hydrocarbyl-substituted succinic anhydrides are good for treating paper, fabric, or other surfaces to impart water repellency. As indicated in U.S. Pat. Nos. 3,102,064, 3,821,069, 3,968,005, and 4,040,900 (RE 29,960), these compositions are particularly useful for sizing paper.

It is also known that these succinic anhydrides are best applied for such purposes in a highly dispersed form, such as an aqueous emulsion. See, for example, U.S. Pat. No. 4,040,900 (RE 29,960), which describes paper sizing emulsions made from mixtures comprising a substituted cyclic dicarboxylic acid anhydride and polyoxyalkylene alkyl or alkylaryl ether or the corresponding mono- or di-ester.

Diester emulsifiers, as well as monoesters, alkyl phenol ethoxylates and alcohol ethoxylates, are disclosed in U.S. Pat. No. 4,040,900 (RE 29,960) as useful emulsifiers for substituted succinic anhydrides. This patent teaches that the polyoxyalkylene portion of the emulsifier must contain between 5 and 20 polyoxyalkylene groups. For polyoxyethylene (polyethylene glycol) type emulsifiers, this corresponds to a molecular weight range of about 238 to 899.

A major drawback of these prior art emulsifiers is the fact that, once formed, the succinic anhydride-emulsifier mixtures are unstable and must be promptly used. There therefore exists a need in the art for substituted succinic anhydride-emulsifier mixtures which demonstrate enhanced stability upon aging or storage.

SUMMARY OF THE INVENTION

The present invention provides a stable hydrocarbyl-substituted succinic anydride/nonionic emulsifier composition comprising:

(A) 70 to 99.5% of a normally liquid hydrocarbyl-substituted succinic anhydride containing from 6 to 50 carbon atoms in the substituent; and (B) 0.5 to 30% of a polyethylene glycol diester emulsifier derived from a polyethylene glycol containing from 21 to 150 ethylene oxide units and a monocarboxylic acid containing from 8 to 25 carbon atoms.

The present invention further provides a method of imparting water repellency to surfaces containing groups reactive to anhydrides which comprises impregnating said surfaces with an aqueous emulsion of the substituted succinic anhydride/nonionic emulsifier composition of the invention.

The present invention is also concerned with a method of sizing paper which comprises intimately dispersing within the wet paper pulp, prior to the ultimate conversion of said pulp into a dry web, an aqueous emulsion of the substituted succinic anhydride/nonionic emulsifier composition of the invention.

Among other factors, the present invention is based on my discovery that polyethylene glycol diesters wherein the molecular weight of the polyethylene glycol is about 1000 or above are surprisingly effective emulsifiers on aging in substituted succinic anhydride. By comparison, commercially available diester emulsifiers wherein the molecular weight of the polyethylene glycol moiety is below about 1000 behave poorly or ineffectively on aging in substituted succinic anhydride.

DETAILED DESCRIPTION OF THE INVENTION

The substituted succinic anhydride useful for this invention is a hydrophobic molecule. Usually it will have one substituent in the 3-position but it may have substituents in both the 3- and 4-positions. In general, the substituent will be an alkyl, alkenyl or aralkyl group. Other elements may be present in a minor amount, such as a sulfur or ether linkage. The total number of carbon atoms in the substituent is between 6 and 50. A preferred substituent size is between 10 and 30 carbon atoms. More preferred is between 12 and 25 carbon atoms. A preferred embodiment of the contemplated anydrides is the alkenyl succinic anhydride made by allowing an olefin to react with maleic anhydride. For present purposes, I shall refer to the anhydrides contemplated as "ASA".

The emulsifier useful for the composition of the present invention is a polyethylene glycol diester derived from polyethylene glycol and a monocarboxylic acid. For purposes of the present invention, the polyethylene glycol will contain from 21 to 150 ethylene oxide units, preferably from about 22 to 90 ethylene oxide units. The molecular weight of the polyethylene glycol will be in the range of about 1000 to 6600, preferably in the range of about 1000 to 4000.

The monocarboxylic acids suitable for use in providing the polyethylene glycol diesters are organic acids containing from 8 to 25 carbon atoms, preferably from 10 to 20 carbon atoms. Suitable monocarboxylic acids include lauric acid, oleic acid and stearic acid. Other acids in this molecular weight range with more unsaturation, such as linoleic, or with ring structures, such as abietic, or with relatively high molecular weight, such as erucic, are suitable. Ketoacids, such as obtained from fatty acid ketene dimers, are also suitable. Mixtures of acids may be used. For example, commercial lauric acid containing minor amounts of capric and myristic acids is suitable.

Representative examples of polyethylene glycol diesters contemplated for use in this invention include polyethylene glycol 1000 (PEG 1000) dioleate, polyethylene glycol 1000 (PEG 1000) distearate, polyethylene glycol 1540 (PEG 1540) dilaurate and polyethylene glycol 4000 (PEG 4000) dioleate. The number which appears after the polyethylene glycol in the above designation represents the degree of polymerization of the polyethylene glycol. More specifically, the number appearing in the designation "polyethylene glycol 1000" indicates that the number of ethylene oxide units in the polymeric compound are such as to yield a total average molecular weight of about 1000. Similarly, polyethylene glycol 4000 has a total average molecular weight of about 4000.

The ASA/emulsifier compositions of the present invention are formed by mixing 70 to 99.5 parts by weight, preferably 80 to 98 parts, of the substituted succinic anhydride with 0.5 to 30 parts by weight, preferably 2 to 20 parts, of the polyethylene glycol diester. These ASA/emulsifier combinations are easy to make at a central location and can be stored and shipped to the location where the ASA emulsions will be made. The two components are miscible and the mixture is liquid at ambient temperatures.

This ASA/emulsifier composition readily emulsifies into water of various hardness and pH with simple mixing in the absence of high shear. Fine droplets are formed and the emulsion is stable until it is used for treating a surface which contains groups reactive to the anydride. The time between formation and use could range from a few seconds to several hours. Longer times are generally not preferred because the anhydride groups will gradually be hydrolyzed by the water present.

The water used can be relatively pure or can contain the usual impurities in domestic water. It can have a pH above or below 7, generally in the range of 3 to 11. Calcium and magnesium hardness ions may be present.

The amount of ASA suspended in the water can vary widely, from a few parts per million to 10% or more depending on the use and method of application. For wood or fabric treatement, concentrations around 1% may be used, whereas for internal paper sizing, the concentration in the pump slurry is normally below about 100 parts per million. Thereby about 0.1 to 1% of ASA is finally absorbed on the paper.

Surfaces to be treated with the ASA/emulsifier compositions of the invention to gain water repellency will contain integral groups which are reactive to the ASA anydride group. This normally will involve reaction with groups such as hydroxyl, amino or mercapto. A preferred type of material which may be treated with emulsions of the compositions of the invention contains carbohydrate molecules, such as cellulose or starch, at the surface of the material. These materials contain many hydroxyl groups which can react with the ASA.

As stated above, the ASA/emulsifier compositions of the present invention may be used to impart water repellency to cellulosic materials. The water-repellent compositions described above are preferably applied to the material in aqueous emulsions. The emulsion may be sprayed onto the material or the material may be dipped into the emulsion in order to distribute the derivative evenly throughout the material. The impregnated material is then withdrawn from the solution and air dried. After air drying, the material is then heated, preferably to a temperature in excess of 100° C., to effect a curing of the impregnated agent within the material. It has been found that one may conveniently use a temperature of about 125° C. for a period of 15 to 20 minutes. At lower temperatures, longer periods of time are required to effect the curing process. To be commercially practical, the curing time should be as short as possible and generally less than one hour. At higher temperatures, the heat curing may be accomplished in shorter periods of time. The upper limit of temperature at which the heat curing process may be carried out is limited to the temperatures at which the cellulosic material begins to decompose. Using the composition of the present invention, it is preferred to impregnate the material with from about 0.5 to 3% by weight of the material of the ASA/emulsifier composition.

The ASA/emulsifier compositions of the present invention may additionally be used as paper sizing agents. These novel sizing agents display all of the features and advantages of prior art sizing agents. Moreover, the novel sizing agents of this invention impart to paper sized therewith a particularly good resistance to acidic liquids such as acid inks, citric acid, lactic acid etc. as compared to paper sized with the sizing agents of the prior art. In addition to the properties already mentioned, these sizing agents may also be used in combination with alum as well as with any of the pigments, fillers and other ingredients which may be added to paper. The sizing agents of the present invention may also be used in conjunction with other sizing agents so as to obtain additive sizing effects. A still further advantage is that they do not detract from the strength of the paper and when used with certain adjuncts will, in fact, increase the strength of the finished sheets. Only mild drying or curing conditions are required to develop full sizing value.

The actual use of these sizing agents in the manufacture of paper is subject to a number of variations in technique, any of which may be further modified in light of the specific requirements of the practitioner. It is important to emphasize, however, that with all of these procedures, it is most essential to achieve a uniform dispersal of the sizing agent throughout the fiber slurry, in the form of minute droplets which can come in intimate contact with the fiber surface. Uniform dispersal may be obtained by adding the sizing agent to the pulp or by adding a previously formed, fully dispersed emulsion. Chemical dispersing agents may also be added to the fiber slurry.

Another important factor in the effective utilization of the sizing agents of this invention involves their use in conjunction with a material which is either cationic in nature or is, on the other hand, capable of ionizing or dissociating in such a manner as to produce one or more cations or other positively charged moieties. These cationic agents, as they will be hereinafter referred to, have been found useful as a means for aiding in the retention of sizing agents herein as well as for bringing the latter into close proximity to the pulp fibers. Among the materials which may be employed as cationic agents in the sizing process, one may list alum, aluminum chloride, long chain fatty amines, sodium aluminate, substituted polyacrylamide, chromic sulfate, animal glue, cationic thermosetting resins and polyamide polymers. Of particular interest for use as cationic agents are various cationic starch derivatives including primary, secondary, tertiary or quaternary amine starch derivatives and other cationic nitrogen substituted starch derivatives, as well as cationic sulfonium and phosphonium starch derivatives. Such derivatives may be prepared from all types of starches including corn, tapioca, potato, waxy maize, wheat and rice. Moreover, they may be in their original granule form or they may be converted to pregelatinized, cold water soluble products.

Any of the above noted cationic agents may be added to the stock, i.e., the pulp slurry, either prior to, along with, or after the addition of the sizing agent. However, in order to achieve maximum distribution, it is preferable that the cationic agent be added either subsequent to or in direct combination with the sizing agent. The actual addition to the stock of either the cationic agent or the sizing agent may take place at any point in the paper making process prior to the ultimate conversion of the wet pulp into a dry web or sheet. Thus, for example, these sizing agents may be added to the pulp while the latter is in the headbox, beater, hydropulper or stock chest.

Further improvements in the water resistance of the paper prepared with these novel sizing agents may be obtained by curing the resulting webs, sheets, or molded products. This curing process involves heating the paper at temperatures in the range of from 80° to 150° C. for periods of from 1 to 60 minutes. However, it should again be noted that post curing is not essential to the successful operation of this invention.

The sizing agents of this invention may, of course, be successfully utilized for the sizing of paper prepared from all types of both cellulosic and combinations of cellulosic with non-cellulosic fibers. The cellulosic fibers which may be used include bleached and unbleached sulfate (kraft), bleached and unbleached sulfite, bleached and unbleached soda, neutral sulfite, semi-chemical chemiground-wood, ground wood, and any combination of these fibers. These designations refer to wood pulp fibers which have been prepared by means of a variety of processes which are used in the pulp and paper industry. In addition, synthetic fibers of the viscose rayon or regenerated cellulose type can also be used.

All types of pigments and fillers may be added to the paper which is to be sized with the novel sizing agents of this invention. Such materials include clay, talc, titanium dioxide, calcium carbonate, calcium sulfate, and diatomaceous earths. Other additives, including alum, as well as other sizing agents, can also be used with these sizing agents.

With respect to proportions, the sizing agents may be employed in amounts ranging from about 0.05 to about 3.0% of the dry weight of the pulp in the finished sheet or web. While amounts in excess of 3% may be used, the benefits of increased sizing properties are usually not economically justified. Within the mentioned range the precise amount of size which is to be used will depend for the most part upon the type of pulp which is being utilized, the specific operating conditions, as well as the particular end use for which the paper is destined. Thus, for example, paper which will require good water resistance or ink holdout will necessitate the use of a higher concentration of sizing agent than paper which does not.

The folowing examples are provided to illustrate the invention in accordance with the principles of this invention but are not to be construed as limiting the invention in any way except as indicated by the appended claims.

EXAMPLES

Examples 1–4

Mixtures of ASA with prior art emulsifiers were made to test emulsifying power and storage stability. The ASA used in these experiments was a commercially available product made from maleic anhydride and a $C_{15-20}$ straight-chain olefin mixture. Roughly equal amounts of each carbon number are present and the double bond position in the starting olefin mixture was almost all internal. The average molecular weight corresponds to about 17.4 carbons in the olefin mixture.

The emulsifiers utilized are typical examples of prior art emulsifiers. They correspond to the four types of emulsifiers described in U.S. Pat. No. 4,040,900 (Re 29,960) as being effective ASA emulsifiers. Igepal CO-630 is a commercial alkylphenol ethoxylate containing about 9 moles of ethylene oxide obtained from GAF. Tergitol TMN-6 is a $C_{12}$ alcohol ethoxylate obtained from Union Carbide. PEG 400 monooleate and PEG 600 dilaurate are a monoester and diester, respectively, of polyethylene glycol (PEG). The PEG average molecular weight is indicated by the notations 400 and 600.

In each example, the emulsifier was dissolved in the liquid ASA at the concentration shown in Table 1. A test of the emulsifying power was made when the mixture was freshly mixed and again after it was aged. Aging was done either by sitting at room temperature for several days or by accelerated aging at 80° C. One hour at 80° C. was equivalent to about 3 days at room temperature and 3 hours at 80° C. was equivalent to about 10 days at room temperature.

the results in Table 1 show that each type of emulsifier is effective when freshly mixed, but all four types demonstrate very poor storage stability.

Examples 5–8

For Examples 5–8, the same ASA was used and the same procedure was followed as in Examples 1–4, except that the emulsifiers utilized demonstrate the teaching of the present invention. The emulsifiers are all diesters produced from polyethylene glycol whose molecular weight ranges from 1000 to 4000 and which is esterified with lauric, oleic and stearic acids.

The results in Table 1 show that these emulsifiers are surprisingly good when freshly mixed with ASA and fully retain their emulsifying power on aging.

Example 9

The procedure of Example 7 was followed except that various ASA compounds were used separately in place of the ASA described previously. In each case, 10% of PEG 1000 dioleate was added. The emulsifiability was tested fresh and after heating for 3 hours at 80° C. The ASA compounds used were:

(1) a branched ASA derived from tetrapropylene;
(2) a branced ASA derived from hexapropylene;
(3) isooctadecyl ASA;
(4) isooctadecenyl ASA; and
(5) a $C_{20}$ ASA derived from a dimer of $C_{10}$ straight-chain alpha olefin.

In each case, satisfactory emulsions were formed both when the mixture was fresh and after aging.

TABLE 1

Storage Stability of ASA/Emulsifier Mixtures

| Example | Emulsifier | Type[1] | % | Storage | Emulsion Rating[2] |
|---|---|---|---|---|---|
| 1 | Igepal | iii | 7 | Fresh | Excellent |
| | CO-630 | | 7 | 3 days at R.T. | Poor |
| | | | 7 | 7 days at R.T. | Ineffective |
| | | | 10 | Fresh | Excellent |
| | | | 10 | 1 hour at 80° C. | Poor |
| 2 | Tergitol | iv | 10 | Fresh | Fair |
| | TMN-6 | | 10 | 1 hour at 80° C. | Poor |
| 3 | PEG 400 | ii | 10 | Fresh | Excellent |
| | Monooleate | | 10 | 1 hour at 80° C. | Poor |
| 4 | PEG 600 | i | 10 | Fresh | Good |
| | Dilaurate | | 10 | 1 hour at 80° C. | Fair |
| | | | 10 | 3 hours at 80° C. | Ineffective |
| 5 | PEG 1540 | i | 10 | Fresh | Good |
| | Dilaurate | | 10 | 3 hours at 80° C. | Excellent |
| 6 | PEG 1000 | i | 10 | Fresh | Good |
| | Distearate | | 10 | 3 hours at 80° C. | Good |
| 7 | PEG 1000 | i | 10 | Fresh | Good |
| | Dioleate | | 10 | 3 hours at 80° C. | Excellent |
| 8 | PEG 4000 | i | 10 | Fresh | Fair |
| | Dioleate | | 10 | 3 hours at 80° C. | Good |

[1](i) Fatty Acid Diester, (ii) Fatty Acid Monoester, (iii) Alkylphenol Ethoxylate, (iv) Alcohol Ethoxylate.
[2]Tested by shaking 1 drop in 25 ml. water; emulsion appearance and turbidity observed over 24 hour period.

What is claimed is:

1. A stable hydrocarbyl-substituted succinic anhydride/nonionic emulsifier composition comprising:

(A) 70 to 99.5% of a normally liquid hydrocarbyl-substituted succinic anhydride containing from 6 to 50 carbon atoms in the substituent; and (B) 0.5 to 30% of a polyethylene glycol diester emulsifier derived from a polyethylene glycol containing from 21 to 150 ethylene oxide units and a monocarboxylic acid containing from 8 to 25 carbon atoms.

2. The composition according to claim 1, wherein the hydrocarbyl substituent of component (A) is selected from the group consisting of alkyl, alkenyl and aralkyl.

3. The composition according to claim 2, wherein the hydrocarbyl substituent of component (A) is alkenyl.

4. The composition according to claim 1, wherein the hydrocarbyl substituent of component (A) contains from 10 to 30 atoms.

5. The composition according to claim 4, wherein the hydrocarbyl substituent of component (A) contains from 12 to 25 carbon atoms.

6. The composition according to claim 1, wherein the succinic anhydride is an alkenyl succinic anhydride derived from maleic anhydride and olefins in the $C_{10}$ to $C_{30}$ range.

7. The composition according to claim 1, wherein the polyethylene glycol of component (B) contains from about 22 to about 90 ethylene oxide units.

8. The composition according to claim 1, wherein the monocarboxylic acid of component (B) contains from 10 to 20 carbon atoms.

9. The composition according to claim 1, wherein the polyethylene glycol of component (B) has a molecular weight in the range of about 1000 to 4000.

10. The composition according to claim 1, wherein the monocarboxylic acid is selected from the group consisting of lauric acid, oleic acid and stearic acid.

11. The composition according to claim 1, wherein the composition is in the form of an aqueous emulsion.

12. A method of imparting water repellency to surfaces containing groups reactive to anhydrides which comprises impregnating said surfaces with an aqueous emulsion of the composition of claim 1.

13. The method of claim 12, wherein said surfaces are cellulosic materials.

14. A method of sizing paper which comprises the step of intimately dispersing within the wet pulp, prior to the ultimate conversion of said pulp into a dry web, an aqueous emulsion of the composition of claim 1.

* * * * *